United States Patent [19]

Kruyt

[11] Patent Number: 4,996,731

[45] Date of Patent: Mar. 5, 1991

[54] ADJUSTABLE BED

[76] Inventor: Robert A. Kruyt, 925 Laird, Apt. 407, Mount Royal, Quebec, Canada, H3R 1Y9

[21] Appl. No.: 340,506

[22] Filed: Apr. 19, 1989

[51] Int. Cl.[5] ..... A61G 7/05

[52] U.S. Cl. ..... 5/67

[58] Field of Search ..... 5/64, 66, 67, 68, 69; 269/324, 323, 325

[56] References Cited

U.S. PATENT DOCUMENTS

| | | | |
|---|---|---|---|
| 2,448,162 | 8/1948 | Weitlaufer | 5/67 X |
| 2,819,475 | 1/1958 | Ericsson . | |
| 3,253,285 | 5/1966 | Fox | 5/67 |
| 3,305,877 | 2/1967 | Nielsen | 5/67 |
| 3,916,461 | 11/1975 | Kerstholt . | |
| 4,083,068 | 4/1978 | Bohme . | |
| 4,100,630 | 7/1978 | Klose et al. | 5/68 X |
| 4,380,838 | 4/1983 | Lutchansky | 5/66 |
| 4,403,357 | 9/1983 | Degen | 5/66 |
| 4,589,151 | 5/1986 | Behrens | 5/68 |
| 4,785,487 | 11/1988 | Toran | 5/67 X |

FOREIGN PATENT DOCUMENTS

| | | | |
|---|---|---|---|
| 719787 | 10/1965 | Canada | 5/67 |
| 1155605 | 10/1983 | Canada . | |
| 2031471 | 1/1972 | Fed. Rep. of Germany | 5/67 |
| 3230094 | 3/1983 | Fed. Rep. of Germany | 5/66 |
| 599646 | 3/1948 | United Kingdom | 5/67 |

*Primary Examiner*—Gary L. Smith
*Assistant Examiner*—Michael J. Milano

[57] ABSTRACT

An improved, adjustable bed having body support sections movable between an aligned, horizontal sleeping position and a tilted, sitting-up position. The bed includes means forming a shallow depression for comfortably receiving a person's buttocks when the bed is in its tilted, sitting-up position.

10 Claims, 3 Drawing Sheets

ADJUSTABLE BED

BACKGROUND OF THE INVENTION

1. FIELD OF THE INVENTION

This invention is directed toward an improved bed.

The invention is more particularly directed toward an improved bed of the type that is adjustable between a horizontal sleeping position and a tilted, sitting-up position.

2. DESCRIPTION OF THE PRIOR ART

Adjustable beds that can be moved or tilted to a sitting-up position are normally made with the body support means formed in sections. Usually there are two or three body support sections hingedly or pivotally connected together. The body support sections are mounted on a bed frame and are movable relative to each other, and to the frame, from a sleeping position, where they are all horizontal to a sitting-up position where at least the first, or upper body support section is tilted to provide a back rest. The other body support sections usually move simultaneously with the upper body support section when it is tilted to try to comfortably accommodate other parts of a person's body in the sitting-up position.

The known adjustable beds have disadvantages however. They are often quite complicated in construction and thus relatively expensive, and prone to breakdowns. Also, a relatively sharp angle is formed between the tilted upper body support section and the next adjacent body support section. This sharp angle causes a separate, one-piece mattress on the bed to fold or bunch in the area where the two body support sections join creating a bulge. This bulge bears against the lower back and/or buttocks of a person using the bed and can be quite uncomfortable. This problem can be minimized by providing a mattress made up of separate, individual mattress sections, each mattress section sized to fit its respective body support section. The mattress sections can be fixedly or removably mounted on the body support sections. However multi-piece mattresses are more expensive than one-piece mattresses; are hard to maintain in position when removably mounted on the body support sections; and can be uncomfortable in a sleeping position if there are wide gaps between the mattress sections.

The known adjustable beds also do not conform comfortably to the human anatomy when in a tilted, sitting-up position. A person's buttocks are generally located in the area where the tilted upper body support section connects to the next adjacent body support section. The relatively sharp angle between the two adjacent, body support sections provides a somewhat uncomfortable position for the buttocks and in addition, the lower back and upper legs of a person are not always properly supported.

SUMMARY OF THE INVENTION

It is the purpose of the present invention to provide an adjustable bed that is relatively simple in construction and operation. It is another purpose of the present invention to provide an adjustable bed that is more comfortable in any position of use.

In accordance with the present invention, an adjustable bed is provided with means forming a shallow depression between the first or upper body support section of the bed and the next adjacent body support section when the upper body section is in a tilted, sitting-up position. This depression, located generally in the middle of the bed, comfortably receives a person's buttocks while in a sitting-up position on the bed. With the buttocks comfortably received in the depression, the upper legs and lower back are also more comfortably supported by the adjacent body support sections. The depression provides a transition area between the angled body support sections that allows the bed to more closely conform to the body's contours. The depression also minimizes folding and bunching of the mattress allowing use of separate, single mattresses on the bed, and making the bed more comfortable.

Preferably, the means forming the shallow depression includes at least two slats forming part of the body support means of the bed. The slats are adjacent to each other, and to the upper body support section, and extend transversely across the bed. The slats are movable between a first horizontal position where they are aligned with the upper body support section when it is in the horizontal sleeping position, and a second, shallow, v-shaped position forming a shallow depression in the bed when the upper body support section is tilted to a sitting-up position.

The depression forming means include first slat support means for supporting the two slats in the first horizontal position. Second slat support means support the slats in the second, v-shaped position. The first slat support means are movable relative to the second slat support means allowing the slats to be supported in either of the two positions as will be described.

The two slats and the second slat support means preferably form a central buttocks support section that is part of the body support means of the bed. The buttocks support section is located between the upper and lower body support sections. The second slat support means in the buttocks support section consists of a frame defining a shallow v-shaped depression. In the horizontal sleeping position of the bed, the first slat support means, comprising a portion of the upper body support section, maintains the slats horizontal and out of the depression in the frame of the buttocks support section. However when the upper body support section is tilted, the first slat support means drops down and eventually moves below the frame of the buttocks support section causing the slats to now be supported on the frame and to form a shallow, v-shaped depression.

Lock means are provided on the bed extending between the upper body support section and the buttocks support section to selectively lock the sections in a horizontal sleeping position, or in any desired sitting-up position.

The invention is particularly directed toward a bed having a frame and body support means. The body support means has upper and lower body support sections. The body support means is horizontal in a sleeping position to provide a flat sleeping surface. The upper body support section is selectively movable relative to the frame from the sleeping position to a tilted, sitting-up position. Means on the body support means form a buttock receiving depression when the upper body support section is moved from its sleeping position to a tilted, sitting up position.

BRIEF DESCRIPTION OF THE DRAWINGS

The invention will now be described in detail having reference to the accompanying drawings in which.

DESCRIPTION OF THE PREFERRED EMBODIMENTS

Figure 1:
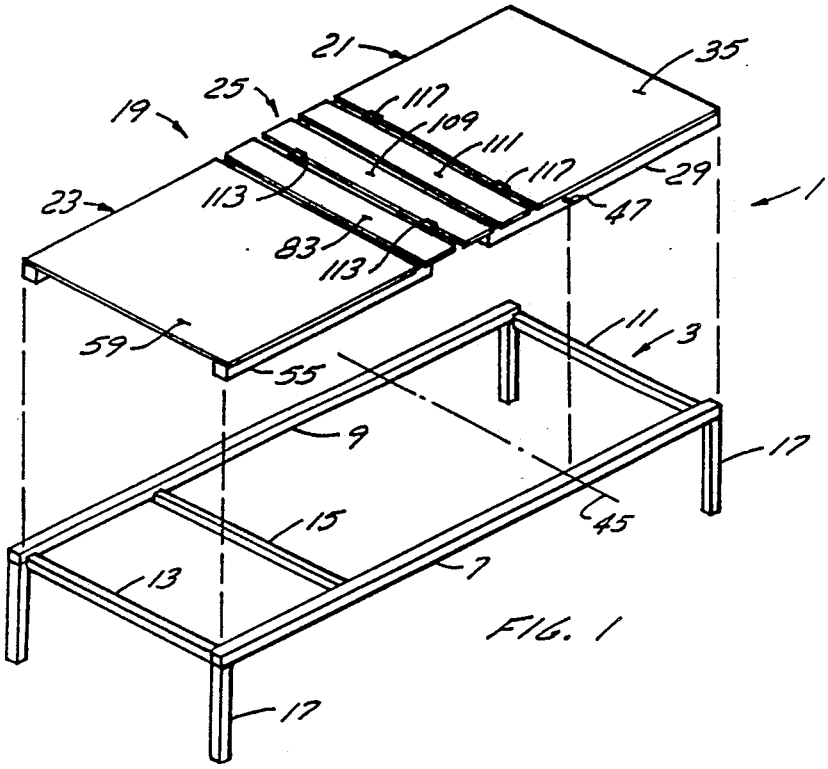
FIG. 1 is an exploded view of the bed showing the frame and the body support means.
Figure 2:
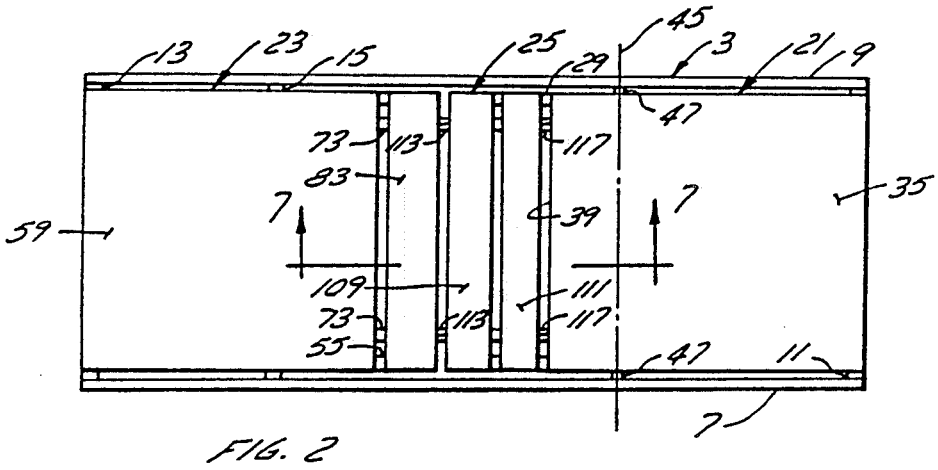
FIG. 2 is a top view of the bed.

The bed 1 of the present invention as shown in FIGS. 1 and 2 has a rigid frame 3. The frame 3 can have a horizontal top platform consisting of parallel side frame members 7, 9 and front and back end frame members 11, 13 joining the side frame members 7, 9 together at their ends. An intermediate cross-frame member 15 extends between the side frame members 7, 9 near, and parallel to, the back end frame member 13. The top platform is rectangular defining the shape and size of the bed and is supported at the proper height by vertical legs 17 at or near the corners.

Figure 3:
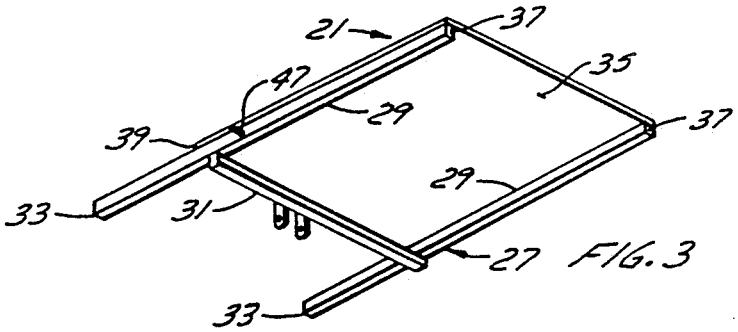
FIG. 3 is a perspective view of the upper body support section of the bed as seen from underneath.

The bed as shown in FIGS. 1 and 2 also has body support means 19, consisting of three body support section 21, 23, 25, mounted on the frame 3. The body support means 19 supports a mattress (not shown) on which a person sleeps. The first body support section 21 supports the upper body of a person on the bed. This first or upper body support section 21 as shown in FIG. 3, has a support frame 27 defined by a pair of parallel side support members 29 and a cross-member 31. The cross-member 31 extends between the side members 29 and is underneath them. The cross-member 31 is located about one-third of the length of the side members 29 from their back ends 33. A rectangular top panel 35 extends across the side support members 29 and helps join them together. This top panel 35 extends from the front ends 37 of the side support members 29 to a position where its back edge 39 is spaced some distance from the back ends 33 of the side support members 29 and close to the cross-member 31. The top panel 35 can, if desired, be replaced by a set of parallel, closely spaced slats extending between the side support members 29.

Figure 4:
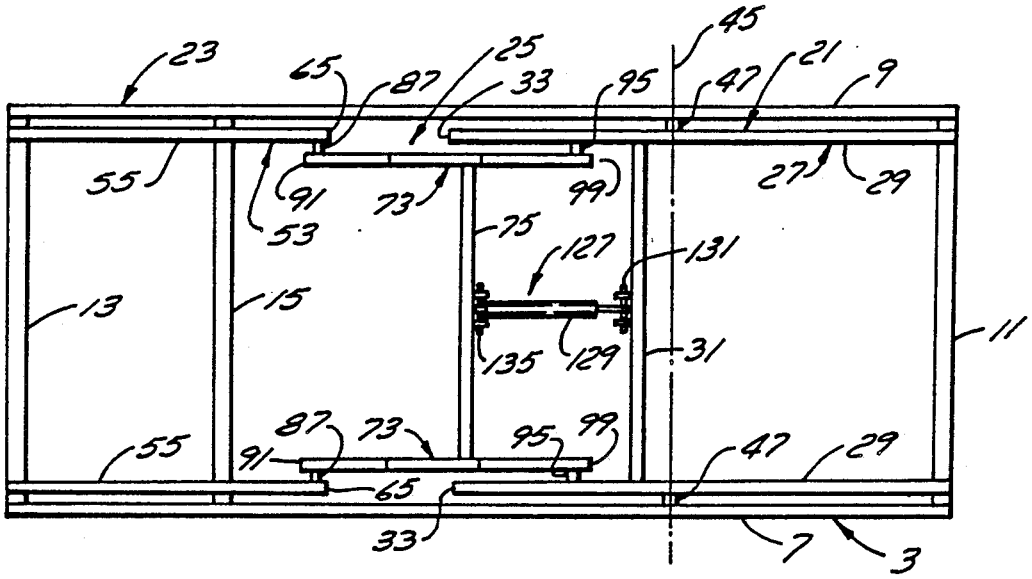
FIG. 4 is a top view of the bed with the panels of the body support means removed.

The upper body support section 21 is pivotally connected to the frame 3 for rotation about a horizontal axis 45 that is parallel to the front and back end frame members 11, 13 as shown in FIG. 4. A pair of pivot members 47 aligned on the pivot axis 45, connects the upper body support section 21 via the side support members 29 of frame 27 to the side frame members 7, 9 respectively of the frame 3. The side support members 29 are located just inside the side frame members 7, 9. The pivot members 47 are located on the frame 27 just to the front of the cross-members 31. The front end of the upper body support section 21, as shown in FIG. 4, usually rests via the side support members 29 on the front end frame member 11. In this position, the upper body support section 21 is in a horizontal sleeping position. The upper body support section 21 can be rotated about the pivot members 47 from its sleeping position to a sitting-up position to provide a sloping back and head rest as will be described.

Figure 5:
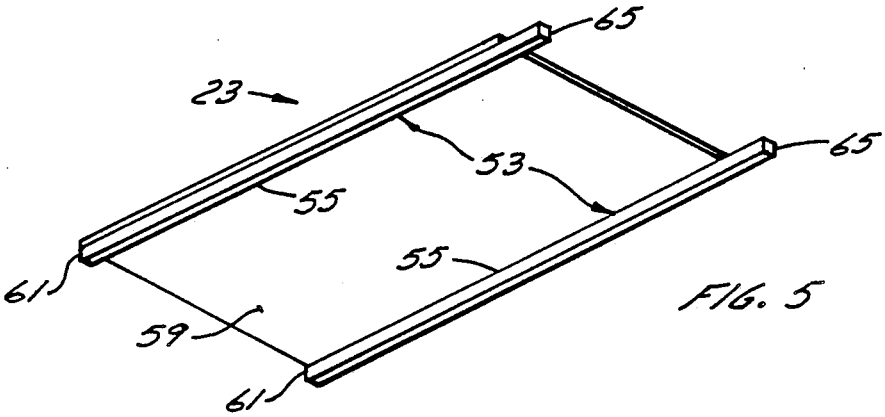
FIG. 5 is a perspective view of the lower body support section as seen from underneath.

The second body support section 23 supports the lower body. This second or lower body support section 23, as shown in FIG. 5, has a frame 53 defined by a pair of parallel side support members 55. A rectangular top panel 59 extends across the side support members 55 and joins them together. The top panel 59 extends from the rear ends 61 of the side support members 55 to a position close to their front ends 65. The top panel 59 can be replaced with a set of parallel, closely spaced slats.

The lower body support section 23 slidably rests on the back end and cross frame members 13, 15 of the bed frame 3 as shown in FIG. 4, in a horizontal sleeping position aligned with the upper body support section 21 when it is in its horizontal sleeping position. The side support members 55 are located just inside and adjacent to the side frame members 7, 9 of the bed frame 3.

Figure 6:
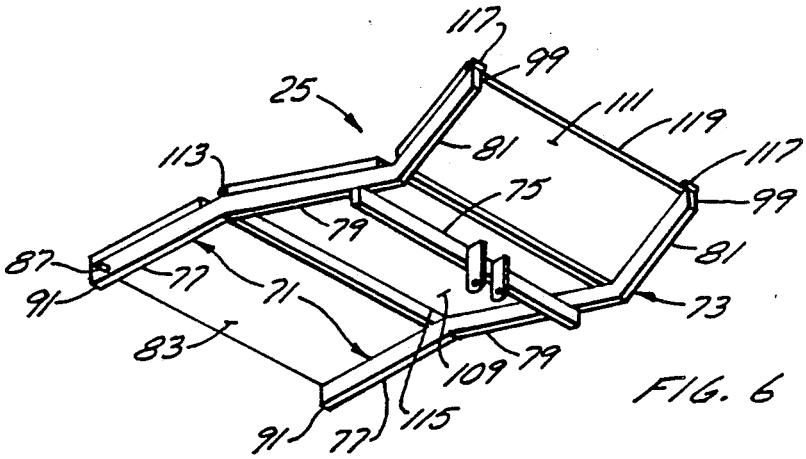
FIG. 6 is a perspective view of the buttock support section as seen from underneath.

The third body support section 25 is mounted between the upper and lower body support sections 21, 23 and supports the buttocks. This third or buttock support section 25 as shown in FIG. 6 includes a frame 71 defined by a pair of side support members 73 and a cross-member 75. Each side support member 73 has a straight, back section 77, a straight, middle section 79 that angles down from the back section 77, and a straight, front section 81 that angles up from the middle section 79. The cross-member 75 extends across the middle sections 79, underneath them and close to the front sections 81. A fixed slat 83 extends across the back sections 77 of the side support members 73 helping to join them together.

The buttock support section 25 is pivotally connected at its back end to the front end of the lower body support section 23 as shown in FIG. 4. A pair of pivot members 87 connect the side support members 73 of the buttock support section 25, adjacent their rear ends 91 to the side support members 55 of rear body support section 23 adjacent their front ends 65.

The buttock support section 25 is also pivotally connected at its front end to the back end of the upper body support section 21. A pair of pivot members 95 connect the side support members 73 of the buttock support section 25, adjacent their front ends 99 to the side support members 29 of the upper body support section 21 a short distance from their back ends 33. The pivot members 95 are located adjacent the back edge 39 of the top panel 35 about midway between the pivot axis 45 and the back ends 33 of the side support members 29. With the upper body support section 21 in its horizontal sleeping position, the back sections 77 of the side support members 73 of the buttock support section 25 are also horizontal, and fixed slat 83 is aligned with top panel 35 of the upper body support section 21 and top panel 59 of the lower body support section 23.

Figure 7:
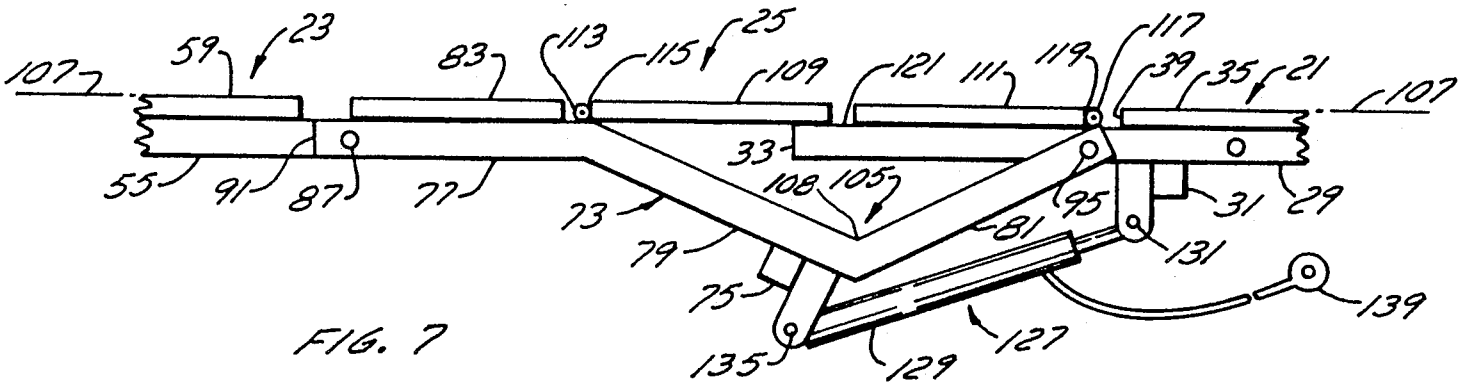
FIG. 7 is a detailed longitudinal cross-section view of the bed taken across line 7—7 in FIG. 2.

The buttock support section 25 includes means for forming a shallow depression therein for receiving the buttocks of a person on the bed when the upper body support section 21 is tilted to a sitting-up position. These depression-forming means, as shown in FIG. 7, include the middle and front sections 79, 81 of the side support members 73 of the buttock support section 25 which define a shallow v-shaped depression 105 beneath the plane 107 defining the flat sleeping surface formed by the top surfaces of slat 83 and top panels 35, 59. The center 108 of this depression 105 is located just forwardly of the back ends 33 of the side support members 29 of the upper body support section 21.

The depression defining means includes a pair of movable slats 109, 111. The movable slats 109, 111 are mounted on the frame 71 of the buttock support section 25 just in front of the fixed slat 83. The movable slats 109, 111 are parallel, closely spaced and extend across the tops of the side support members 73. One of the slats 109 is pivotally connected to the side support members 73 by hinges 113 along one side edge 115. The hinges 113 are connected to the side support members 73 at the junction of sections 77, 79. The other slat 111 is pivotally connected to the side support members 73 by hinges 117 along one side 119. The hinges 117 are connected to the side support members 73 adjacent the free end of section 81.

In the horizontal sleeping position of the bed, the rear portions 121 of the side support members 29 of the upper body support section 21 extend rearwardly of the front portion of the buttock support section 25 to a position to underlie the front portion of the rearmost movable slat 109 as shown in FIG. 7. At the same time the rear portions 121 also underlie the forward movable slat 111. The rear portions 121 of the side support members 29 maintain the slats 109, 111 in a horizontal position aligned with the fixed slat 83 and the panels 35, 59 of the upper and lower body support sections 21, 23 respectively.

Means 127 are provided for maintaining the body support sections 21, 23, 25 fixed relative to each other on the bed frame to maintain the plane 107 defining the flat, horizontal sleeping surface. These maintaining means 127 comprise an extendable, rigid, mechanically-operated locking lever 129 connected between the buttock support section 25 and the upper body support section 21. The lever 129 is pivotally connected at its front end by pivot means 131 to cross-member 31 extending between the side support members 29 of the upper body support section 21. The lever 129 is also pivotally connected at its rear end by pivot means 135 to cross-member 75 extending between the side support members 73 of the buttock support section 25.

The lever 129 acts as a lock to hold the buttock support section 25 and upper body support section 21 fixed in the horizontal sleeping position. A mechanical actuator 139 connected to the lever 129 can be operated to unlock it allowing it to lengthen. This permits the upper body support section 21 to tilt about the pivots 47 to a back rest position. When the desired slope is obtained, the actuator 139 is operated to lock the lever 129 in its extended position and to thus lock the upper body support section 21 in its desired back rest position. Unlocking of the lever 129 allows the body support sections to be moved to a horizontal sleeping position when desired. The locking lever 129 can be of any well known type used in chairs to adjust the angle of the back rest relative to the seat. Examples of such locking levers are shown in Canadian Patent Nos. 1,001,965 and 1,001,966. While a mechanical locking lever 129 has been described, the locking lever can also by hydraulically or electrically operated.

Figure 8:
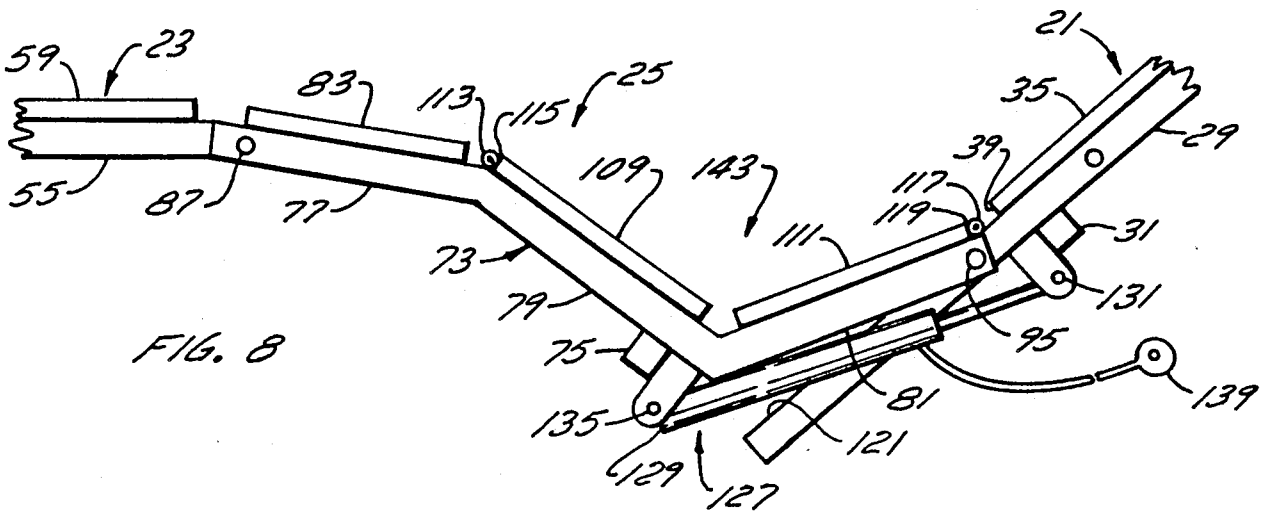
FIG. 8 is a view similar to FIG. 7 but taken with the bed in a sitting-up position.

When it is desired to move the back support section 21 from the horizontal sleeping position to a tilted, sitting-up position, as shown in FIG. 8, the lever 129 is unlocked, and the person on the bed applies downward body pressure on buttock support section 25. This causes the upper body support section 21 to rotate about pivots 47 in a counter-clockwise manner as it moves to a back rest position of any desired angle. As the upper body support section 21 rotates, the rear portions 121 of its side support members 29 move down and pass beneath the side support members 73 of the buttock section 25. As the rear portions 121 of the side support members 29 move down, the slats 109, 111 also move down, pivoting about hinges 113, 117. As the rear portions 121 pass below the side support members 73 the slats 109, 111 are picked up by the side support members 73 and supported by the middle and front sections 79, 81 to form a shallow, buttock receiving depression 143. This depression 143 accommodates any fold formed in the mattress on the bed as the upper body support section 21 is tilted and also provides a shallow depression to comfortably accommodate a human body's natural shape.

As the upper body support section 21 tilts, the buttock and lower body support sections 25, 23 are drawn slightly forwardly by their pivot connection to the upper body support section. Once the desired tilt position has been reached, the lever 129 is locked to retain the body support sections in the selected position. The bed can be returned to its normal horizontal position by unlocking the lever 129 and applying body pressure to the tilted upper body support section 21 to move it to its horizontal position. As the rear portions 121 of the side support members 29 of the upper body support section 21 rise past the angled portions 79, 81 of the buttock support section 25, they pick up slats 109, 111 pivoting them about their hinges 113, 117 to a horizontal position.

The buttock support section 25 can be constructed in different ways. For example, the second movable slat 111 could be pivotally mounted to the front end of the first movable slat 109. Alternatively, the second movable slat 111 could be hingedly mounted on the rear portion of the upper body support section instead of on the front end of the buttock support section.

It will be noted that the buttock receiving depression 143 starts to form as soon as the upper body support section begins tilting. As the rear portions 121 of the side support members 29 begin to move down, the slats 109, 111 immediately move down with them, pivoting about hinges 113, 117 forming a deepening depression. The depression 143 is of maximum size once the side support members 29 move beneath the side support members 73 of the buttock support section 25. These side support sections 73 prevent further movement of the slats 109, 111 and define the maximum depression size.

The frame 3 of the bed can also be constructed in different ways. The frame can for example be mounted entirely beneath the body support means with clearance provided for the central downward movement of the adjacent portions of the upper body and buttock support sections along with the lever.

Two bed units can be located side by side to provide a double bed. Each unit operates independently of the other to provide each person with freedom to control their side of the double bed without interfering with the other person's side.

I claim:

1. A bed having: a frame; body support means; the body support means having upper and lower body support sections; the body support means being horizontal on the frame in a sleeping position to provide a flat sleeping surface; the upper body support section selectively movable relative to the frame from the sleeping position to a tilted sitting-up position; two adjacent slats extending across the bed between the upper and lower body support sections forming a buttock receiving depression when the upper body support section is moved from its sleeping position to a tilted sitting-up position; means for maintaining the slats horizontal in the sleeping position and means for moving the slats to a shallow V-position to form the depression when the upper body section moves to a tilted sitting-up position, the means maintaining the slats horizontal comprising a portion of the upper body support section extending under the slats when the body support means is in a sleeping position.

2. A bed as claimed in claim 1 wherein the means for moving the slats to a shallow v-position include: frame means beneath the portion of the upper body support section that extends under the slats, said frame means defining a v-shaped depression, said portion of the upper body support section movable below the frame means to have the frame means support the slats in a shallow v-shape.

3. A bed as claimed in claim 1 including means for selectively locking the bed in any position.

4. A bed having a frame; an upper body support section pivotally mounted to the frame; a buttock support section on the frame and pivotally mounted at one end to the upper body support section; a lower body support section on the frame and pivotally mounted at one end to the other end of the buttock support section; the support sections movable relative to the frame between a sleeping position and a sitting-up position; the buttock support section having a frame and a pair of slats hingedly mounted on the frame of the buttock support section; means on the upper body support section for supporting the slats in the sleeping position of the support sections; and means on the frame of the buttock support section for supporting the slats to form a V-shaped buttock receiving depression in the sitting-up position of the support sections.

5. A bed having: a frame; upper body, buttock and lower body support sections mounted on the frame; means on each support section combining to provide a flat sleeping surface in a sleeping position of the support sections, means on the upper body support section for partly supporting the sleeping surface means on the buttock support section in the sleeping position; the support sections movable relative to the frame to a sitting-up position where the sleeping surface means on the buttock support section form a V-shaped buttock receiving depression and are now completely supported by and rest on the buttock support section.

6. A bed as claimed in claim 5 wherein the buttock support section has a frame defining a V-shaped depression and the sleeping surface means on the buttock support section include a slat hingedly mounted to the frame on each side of the depression.

7. A bed having: a frame; upper body, buttock and lower body support sections mounted on the frame, the support sections movable relative to the frame between a sleeping position and a sitting-up position; the buttock support section having a frame defining a V-shaped depression and slat means hingedly mounted on the frame of the buttock support section above the depression; the upper body support section having means to support the slats above the depression in the sleeping position of the support sections; the frame of the buttock support section supporting the slats in the V-shaped depression in the sitting up position of the support sections.

8. A bed as claimed in claim 7 including means pivotally connecting the upper body support section to the frame; means pivotally connecting the buttock support section to the upper body support section, and means pivotally connecting the lower body support section to the buttock support section.

9. A bed having: a frame; body support means; the body support means having upper body, buttock and lower body support sections; the body support means horizontal on the frame in a sleeping position to provide a flat sleeping surface; the upper body support section selectively movable relative to the frame from the sleeping position to a tilted sitting-up position; means on the buttock support section forming a buttock receiving depression when the upper body support section is moved from its sleeping position to a tilted, sitting-up position, said depression forming means including a frame on the buttock support section defining a shallow V-shaped depression and a pair of slats hingedly mounted on top of the frame, one on each side of, and overlying the depression; and means for maintaining the slats in a horizontal position above the depression when the bed is in a sleeping position.

10. A bed as claimed in claim 9 wherein the means for maintaining the slats in a horizontal position comprise a portion of the upper body support section.

* * * * *